United States Patent [19]

Olander et al.

[11] 4,166,201

[45] Aug. 28, 1979

[54] IGNITION DISTRIBUTOR ELECTRODE FOR SUPPRESSING RADIO FREQUENCY INTERFERENCE

[75] Inventors: William C. Olander, Birmingham; Douglas J. Harvey, Sterling Heights; David S. Eddy, Romeo, all of Mich.

[73] Assignee: General Motors Corporation, Detroit, Mich.

[21] Appl. No.: 868,078

[22] Filed: Jan. 9, 1978

[51] Int. Cl.[2] ..... H01H 19/00; H01H 1/00

[52] U.S. Cl. ..... 200/19 DR; 123/146.5 A; 123/148 R; 123/148 P; 200/19 R; 200/262; 200/264; 200/270

[58] Field of Search ..... 200/19 R, 19 DC, 19 DR, 200/262–270, 279; 123/146.5 A, 148 R, 148 P

[56] References Cited

U.S. PATENT DOCUMENTS

| | | | |
|---|---|---|---|
| 1,395,269 | 11/1921 | Gebauer | 200/270 X |
| 2,294,783 | 9/1942 | Ely | 200/264 |
| 3,317,773 | 5/1967 | Inoue | 313/171 |
| 4,007,342 | 2/1977 | Makino et al. | 200/19 R |
| 4,039,787 | 8/1977 | Hori et al. | 200/19 DR X |
| 4,074,090 | 2/1978 | Hayashi et al. | 200/19 DR |
| 4,091,245 | 5/1978 | Komiyama et al. | 200/19 R |

FOREIGN PATENT DOCUMENTS

| | | | |
|---|---|---|---|
| 576566 | 4/1946 | United Kingdom | 200/266 |

*Primary Examiner*—James R. Scott
*Attorney, Agent, or Firm*—George A. Grove

[57] ABSTRACT

An ignition distributor for an internal combustion engine is provided with a novel rotor electrode which substantially reduces radio frequency interference generated by spark discharges across the rotor gap. At least the tip segment of the rotor electrode is formed of a composite material consisting of a first phase of fibers of a dielectric material interspersed with a second phase of a conductive material. In operation, dielectric fibers protrude from the conductive phase into the gap promoting ionization therein so that electrical discharge occurs at voltages where radio frequency signal production is substantially suppressed.

4 Claims, 7 Drawing Figures

IGNITION DISTRIBUTOR ELECTRODE FOR SUPPRESSING RADIO FREQUENCY INTERFERENCE

This application is related to U.S. Serial No. 868,079, filed Jan. 9, 1978, assigned to the assignee of this invention.

BACKGROUND OF THE INVENTION

This invention relates to ignition distributors for internal combustion engines having novel rotor electrodes which suppress radio frequency noise generation. More particularly, the invention relates to distributor rotors wherein at least the tip of the rotor electrode comprises a composite material containing a substantial portion of fibers of a dielectric material interspersed with a phase of an electrically conductive material. The dielectric fibers protrude from the metal phase of the tip adjacent to the rotor gap. In the operation of the distributor, electrical phenomena associated with the protruding dielectric fibers lead to significant reduction of the voltage required to break down the gap between the rotor electrode and a stationary spark plug lead terminal (hereinafter rotor gap). At such lowered breakdown voltages, radio frequency interference is appreciably suppressed.

It is well known that radio frequency interference (RFI) in vehicles powered by spark ignition internal combustion engines is brought about for the most part by high voltage spark discharges across the rotor gap. The source of the RFI signal is the large, fast rise time impulsive current generated at the onset of the rotor gap breakdown. It has been noted that the higher the voltage required to break down the gap, the higher the intensity of the radio frequency interference noise. This is particularly troublesome with modern high energy ignition distributors which at present generally have breakdown voltages at the rotor gap of over 20 kV. We have found that if such breakdown voltage is reduced to less than about 12 kV, the production of radio frequency energy is suppressed and the radio noise substantially reduced.

OBJECTS OF THE INVENTION

It is therefore an object of our invention to provide a RFI noise suppressing ignition distributor. It is a further object to provide an ignition distributor with a high tension rotor electrode that encourages the electrical breakdown of the rotor gap at voltages where RFI signal generation is substantially suppressed. It is a more specific object of our invention to provide such an electrode wherein at least the tip of the rotor electrode consists of a two-phase composite material having a dielectric portion of small fibers interspersed with an electrically conductive portion of a suitable material. The dielectric fibers protrude from the end of the tip promoting electrical breakdown of the rotor gap at voltages where RFI is substantially suppressed. Another object of our invention is to provide high tension rotor electrodes which in use afford continuous RFI suppression and long service life due to unique wear characteristics. The dielectric fiber phase always protrudes at the spark gap while a portion of each fiber is firmly anchored in the conductive phase.

BRIEF SUMMARY OF THE INVENTION

In accordance with a preferred embodiment of the invention, these and other objects are accomplished as follows. A conventional internal combustion engine ignition distributor is equipped with a rotor mounted on a rotor shaft adapted to be rotated by the engine cam shaft. The distributor rotor carries an electrode that is in electrical contact with a source of high voltage electrical energy. The radially outboard tip of the rotor electrode traces a circumferential path that successively brings it into registration with one or more circumferentially spaced stationary spark plug cable lead terminals positioned in the distributor cap. In our invention, at least the tip segment of the rotor electrode is made of fibers of a suitable dielectric material such as a silica glass interspersed with a suitable electrically conductive material such as copper. The dielectric material extends microscopically radially outboard the conductive material at the tip adjacent to the rotor gap. When the rotor electrode of an operating distributor moves into close proximity to a spark plug cable lead terminal the protruding dielectric material is believed to produce a nonuniform electric field and associated electrical phenomena which cause the gap to break down at lower voltages than a standard metal rotor tip segment. We have found that when the tip is made of a composite material containing at least 10% by volume of the fibrous dielectric material interspersed with a conductive material, rotor gap breakdown voltages are appreciably lowered and RFI noise is substantially suppressed.

BRIEF DESCRIPTION OF THE DRAWINGS

Our invention will be more fully appreciated and clearly understood from a detailed description which follows. Reference will be made to the drawings in which.

DETAILED DESCRIPTION OF THE INVENTION

Figure 1:
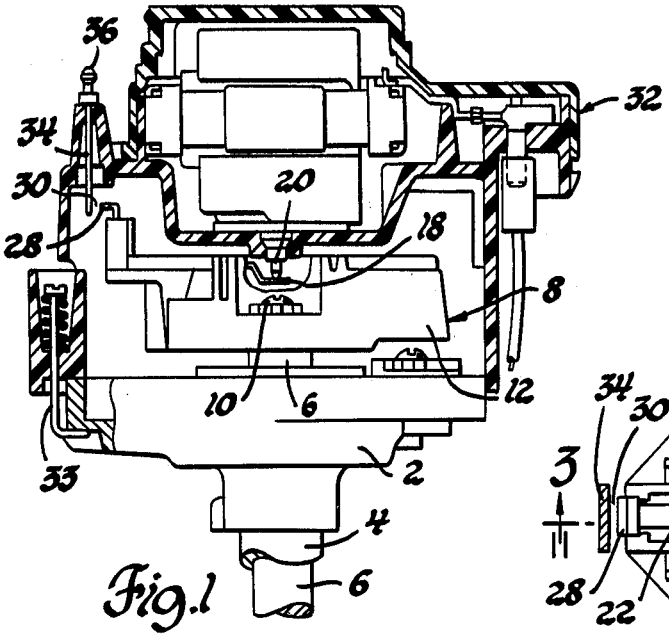
FIG. 1 is an elevational view, partly broken away and in section, of an automobile ignition distributor showing a distributor rotor electrode of our invention positioned in spark gap relation to a stationary spark plug cable electrode.

In a preferred embodiment and referring to FIG. 1, a view of a typical high energy automobile ignition distributor is shown. A distributor housing 2 is mounted on a stationary rotor shaft housing 4. Confined within housing 4 is rotor driving shaft 6 which is generally gear coupled with the engine cam shaft. A rotor 8 is mounted on the driving shaft 6 by screws 10 so that the rotor 8 rotates with the driving shaft 6. The rotor 8 comprises an insulating base 12 which is generally molded from an electrically nonconductive thermoplastic molding material. As can be seen more clearly in FIG. 2, a two-part conductive rotor electrode 14 is mounted in the plastic rotor base 12. The electrode 14 extends radially from the center of rotation 16 of the rotor 8 slightly beyond the outside perimeter of the rotor base 12. In the illustrated embodiment of our invention, the radially inward portion 18 of the electrode 14 is a flat stainless steel strip which is slightly bent so as to bias against protruding secondary coil high tension electrode 20 assuring electrical connection therebetween. As seen clearly at FIG. 3, the radially outward portion 22 of electrode 14 is clamped against the radially inward portion 18 by tab 24. An electrical connection is formed between the two rotor electrode portions at interface 26. At least the tip 28 of the outward portion 22 of electrode 14 is made of a composite material according to our invention wherein dielectric fibers protrude from the conductive material of the tip 28 adjacent rotor gap 30. The remainder of the electrode portion 22 may be made of any suitable conductive material such as copper. It should be noted that other rotor designs would be equally suitable for the practice of our invention so long as at least the tip of the electrode is incorporated according to our invention.

Referring to the cut-away section of FIG. 1, ignition distributor cap 32 is mounted on the distributor rotor housing 2 by means of spring loaded clips 33. A plurality of high tension spark plug cable lead terminals 34 are mounted in the cap 32 in a circular pattern. During operation, a spark plug cable is connected to each spark plug cable terminal at a connector 36. The terminals 34 are positioned in the cap 32 so that they successively come into spark gap relation with the rotor electrode tip 28 as the rotor 8 is driven by the driving shaft 6. The space between the rotor electrode tip 28 when it is substantially radially aligned with spark plug cable lead terminals 34 is referred to as the rotor gap 30. It is generally across this gap that high energy ignition sparks are generated to induce a high voltage in the associated spark plug cable in order to fire the connected plug.

The operation of a distributor such as that shown in FIGS. 1 to 3 as it pertains to the practice of our invention can be described briefly as follows. As rotor 8 is turned by driving shaft 6, an electric signal passes through a primary distributor coil to electrical ground. In order to successively fire the spark plugs, at certain points in the rotation of the rotor an ignition module stops the flow of current through the primary winding, inducing a high voltage impulse in the secondary coil and terminal 20. This occurs at about the same time the rotor electrode tip 28 is lined up directly with a spark plug cable lead terminal 34. Current flows through the rotor electrode 14 until the voltage becomes high enough to electrically break down the rotor gap 30. A spark is generated across the gap 30, causing a high tension current to flow in the spark plug cable to fire the associated spark plug. It is well known that the fast rise time impulsive high voltage current which flows at the onset of the electrical breakdown of rotor gap 30 creates radio frequency interference. It has also been found that the higher the breakdown voltage, the more radio frequency noise. Our invention provides a means of lowering the gap breakdown voltage to suppress radio noise interference by providing a rotor electrode 14 with a special tip 28. The electrode tip 28 comprises a composite material containing an electrically conductive phase such as copper interspersed with fibers of a refractory dielectric material. The dielectric fibers protrude from the tip of the surface, encouraging ionization in the rotor gap 30 and gap breakdown at lowered voltages where RFI noise generation is suppressed. In cars equipped with our novel rotor electrodes radio noise caused by spark discharge across the rotor gap is so low that it is essentially inaudible.

Suitable conductive materials for composite electrode tips according to our invention are those which are good electrical conductors and have melting points high enough that they are not substantially degraded by localized heating at the spark interface. Metals such as copper, nickel, silver, brass, aluminum and their high melting alloys are suitable, although other materials not mentioned may be as well suited.

Similarly, suitable fibrous dielectric materials have melting points high enough that they do not degrade because of localized heating at the spark interface. Herein we refer to such fibers as being refractory dielectric materials. By dielectric materials we mean materials which do not readily conduct a flow of electrons. Among fibers successfully employed are those comprised of alumina and zirconium oxide (Saffil®), yttrium stabilized zirconium oxide (Zircar®), alumina and silica (Fiberfrax®) and fused silica glass. Other fibers would be equally suited to the practice of our invention and our invention is not limited to those disclosed above. The fibers may range in size from about a few microns in diameter to 100 microns or more and preferably have a length to diameter ratio in the range of about 5:1 to 10:1 or greater.

Generally, we have formed distributor gap electrode tips by compacting and sintering or hot pressing mixtures of refractory dielectric fibers and metal particles. We have found that if the electrode composition comprises at least about 10% by volume of the dielectric material, breakdown voltages across the rotor gap are generally less than about 10 kV.

In some embodiments we fused dielectric fibers and metal particles and then etched the surface to initially dissolve some of the metal and leave a rugged surface with a protruding dielectric phase. In other embodiments, the materials were pressed and sintered so that the particulate nature of each phase was maintained. The fabrication can also be manipulated so that one phase melts and the other does not. It does not appear to matter whether the conductive or dielectric phases of a tip material are fused or discretely particulate so long as the dielectric fiber phase protrudes from the surface of the tip into the rotor gap. Preferably, the conductive phase is continuous throughout the electrode tip material so that an electric current can flow unimpeded to the gap surface.

We have postulated several possible theories to account for the significant decrease in distributor gap breakdown voltages and resultant RFI noise suppression brought about by the use of our novel composite electrodes. However, these theories as set forth herein do not in any way limit the scope of our invention as claimed.

The voltage breakdown phenomena across a distributor gap are related to the electric field in the gap. The conduction of electricity (in the form of a spark)

through the air in a gap takes place by the transport of free electrons. Electrons are accelerated away from the electrode tip by an applied electric field and may collide with air molecules to produce more free electrons and air ions which in turn can collide with even more air molecules producing a so-called avalanche effect. The more electrons there are in the gap at a particular moment, the more probable it becomes that it will break down and spark. We believe that the rotor electrodes of our invention provide more initiatory electrons at the rotor gap at any given time at lower voltages than prior art rotors because of the dielectric fibers protruding from the electrode at the gap.

There are several possible theoretical mechanisms by which these electrons may be generated. For example, electrons may be emitted from the protruding dielectric fibers in the high voltage electric field induced in the rotor electrode by the distributor secondary coil. Another possibility is that weakly bonded electrons which collect on the protruding dielectric fibers are released into the gap at reduced breakdown voltage levels. Another possibility is that the field is enhanced around the protruding fibers allowing electrons to be ejected at lower system voltages. It should be noted that all of these effects are related to the electrical phenomena associated with the protrusion of the dielectric fibers at the electrically biased surface of a rotor electrode tip.

In the prior art, attempts have been made to suppress RFI noise by coating conventional metal rotor electrodes with a dielectric or semiconductive layer. Although this practice temporarily reduces RFI, probably because the coating layer functions as a resistor in series with the electrode, the therapeutic effect of the coating soon diminishes because it is eroded in service. Unlike such prior art electrodes, our invention provides a long lived and continuously operative noise suppressing rotor which is not adversely effected by use. In a rotor tip of our invention the rugged protruding surface of refractory dielectric material is constantly replenished. As the surface at the spark is slowly eroded, the dielectric fibers beneath are exposed. Tips have been periodically examined over the course of the equivalent of 50,000 miles of in-car service, and all such examinations revealed a surface with a protruding dielectric fiber phase.

Figure 5:
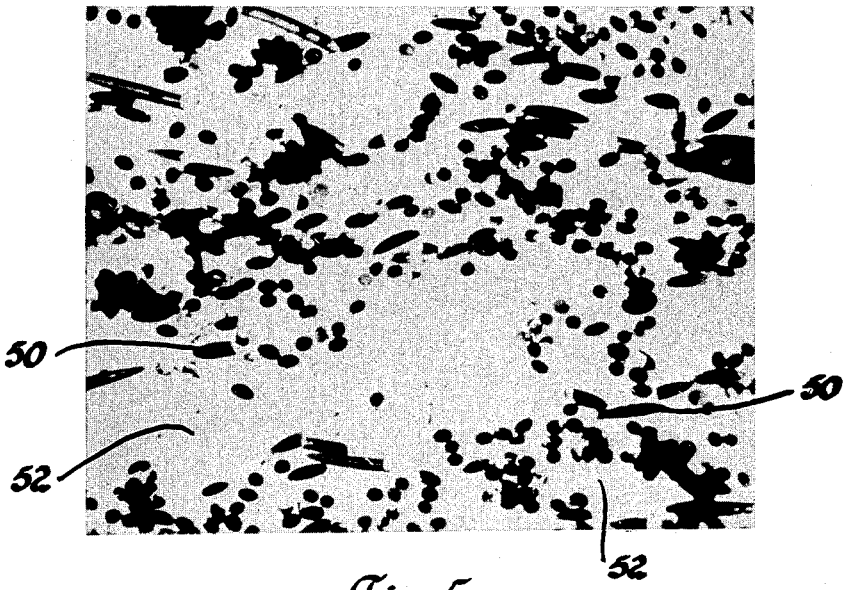
FIG. 5 is a photomicrograph at 250X magnification of silica fibers protruding from a copper matrix at the surface of a rotor electrode tip.
Figure 6:
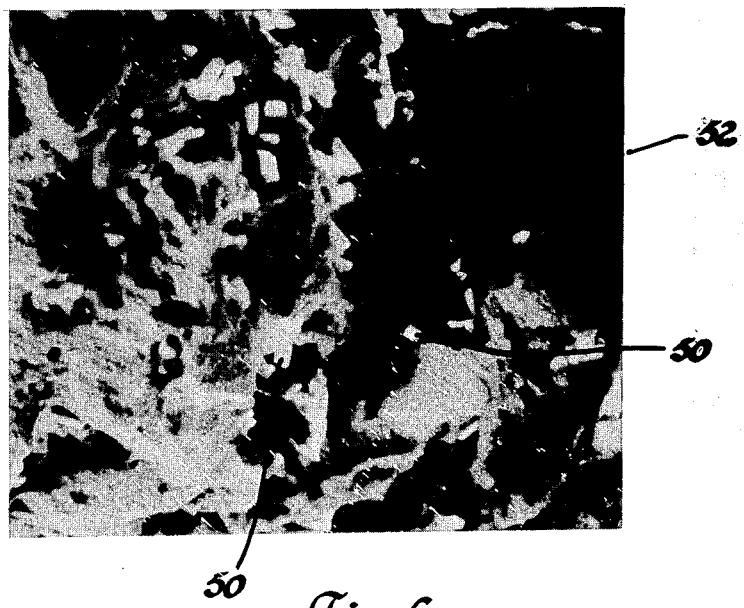
FIG. 6 is a SEM at 300X magnification of silica fibers protruding from a copper rotor electrode tip surface.

In accordance with a preferred embodiment of our invention, a RFI suppressing rotor electrode tip was formed as follows. 10 parts by weight chopped fused silica fibers approximately 8 to 15 microns in diameter with a length to diameter ratio of about 10 were mixed with 90 parts by weight −200+300 mesh copper powder and water in a high shear blender. The mixture was quickly transferred to a vacuum filter and dewatered. The dried material was vacuum hot pressed in a graphite die at 1450° F. under a pressure of 4000 psi for 15 minutes. The compact was cooled under vacuum and load. A rotor tip was sawed from the hot pressed material and the end to be positioned at the spark gap was etched in a 50% nitric acid solution to expose the silica fibers. The measured electrical resistance across the segment was less than 10 ohms, indicating that the conductive metal phase was continuous. FIG. 5 is a photomicrograph at 250X magnification of a rotor tip formed by this method where the dark particles 50 are silica fibers and the lighter background matrix 52 is copper. FIG. 6 is a SEM at 3000X magnification of the fibers 50 protruding from the copper matrix 52.

Figure 2:
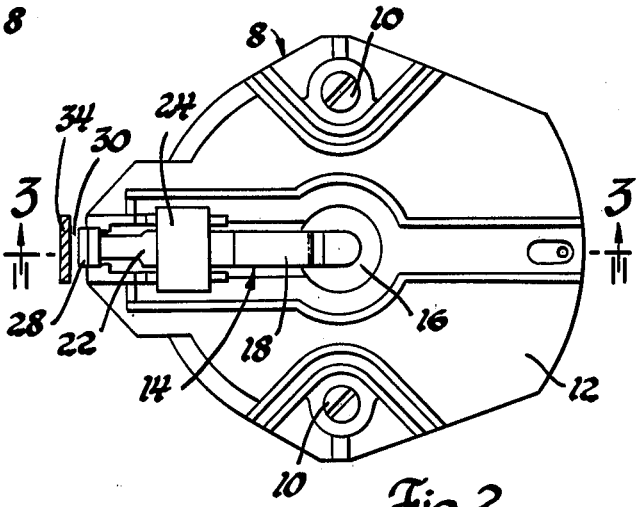
FIG. 2 is a plan view of the distributor rotor shown in FIG. 1.
Figure 3:
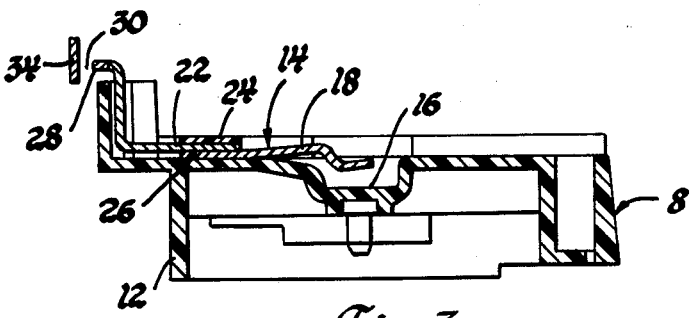
FIG. 3 is a sectional view of FIG. 2 taken along line 3—3 looking in the direction of the arrows.
Figure 4:
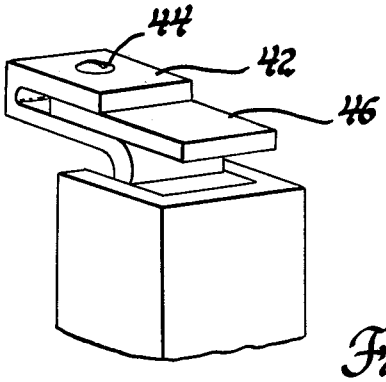
FIG. 4 is a perspective view of a part of a rotor used for testing electrode tips fabricated from various composite materials in accordance with the practice of our invention.

A rotor tip fabricated as above was tested in a rotor similar to that shown at FIGS. 2 and 3, equipped with a modified copper clamping electrode 42 shown at FIG. 4. Various tips 46 could be easily clamped in place for testing and removed for microscopic examination by manipulating screw 44. The test rotor was placed in an otherwise standard high energy automobile ignition distributor as shown at FIG. 1. The distributor was mounted in bench service testing equipment which simulates distributor operation in an automobile ignition system under controlled condition. A spindle, corresponding to the rotor driving shaft in an automobile, was set to rotate the rotor at a desired rate and the primary distributor coil was connected to a 12 V D.C. source. The distributor output terminals were shorted together and connected to ground through standard television and radio suppression (TVRS) spark plug cable. Testing was done with vacuum advance adjusted so that sparking occurred along the surface of the rotor electrode tip at the gap. The voltage at the rotor tip was monitored on an oscilloscope as a function of time. A Stoddart spiral cone antenna (No. 93490-1, 200–1,000 MHz) was placed in near field and interphased with a Hewlett Packard 8551-A Spectrum Analyzer to monitor the RFI noise at frequencies in the range of 0 to 1,000 MHz. The RFI noise output was measured on the spectrum analyzer in the range of from 0 to 40 decibels above one microvolt per meter per kilohertz (relative db).

Figure 7:
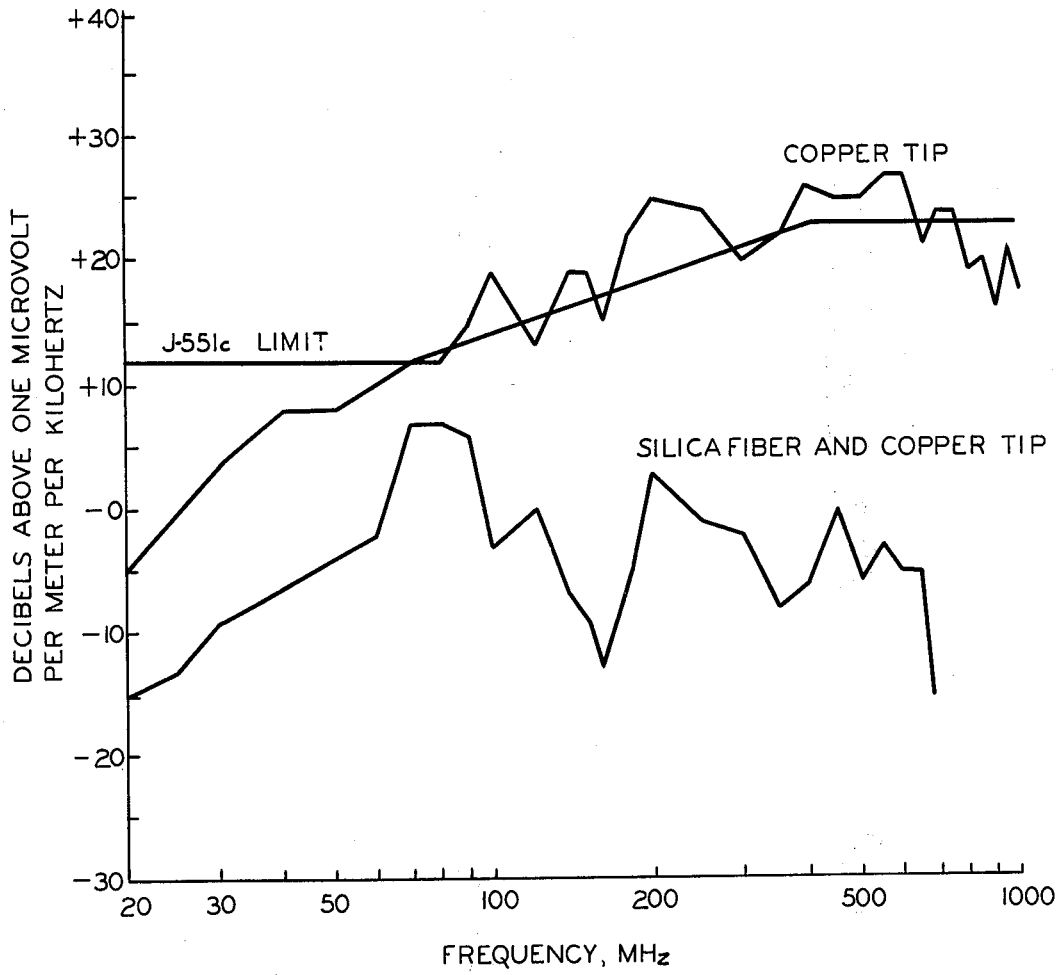
FIG. 7 is a graph of RFI noise intensity plotted as a function of frequency for a copper rotor electrode and a rotor electrode of the subject invention comprising a dielectric constituent of silica glass fibers in a copper matrix.

The tip was aged and tested in the bench equipment at a rotor speed of 1750 rpm for 182 hours, equivalent to about 18,200 miles of in-car service. During the test period, the distributor gap breakdown voltage was measured to be 10 kV or less, and the RFI output was judged quiet in the frequency range between 20 and 1,000 MHz as measured by the spectrum analyzer attached to the conical antenna. The same rotor and tip were then transferred to an otherwise standard high energy ignition distributor of a 1977 Buick Riviera. The distributor containing the rotor tip was tested for radio frequency interference noise using SAE test procedure J-551c. Briefly, the test procedure entails measuring the horizontal and vertical components of the RFI field (in units of relative decibels) received by an antenna positioned ten meters from the right and left hand sides of a vehicle. Noise readings are taken at suitable intervals over the frequency range of 20–1,000 MHz at bandwidths not greater than 1 MHz. The highest relative db signal measured at a particular frequency is recorded, and may be checked against the "quiet" radiation operating limit prescribed by the test. Fig. 7 shows the test results for the subject rotor tip. As seen from the Figure, the rotor electrode tip of our invention suppressed RFI signal generation to a level well below the acceptable noise limit according to the SAE J-551c test and that RFI noise is substantially suppressed in relation to that generated by a plain copper rotor electrode tip.

Other tip segments were formed from electroless copper or nickel plated fused silica fibers hot pressed with copper powder. 5 gram portions of fused silica fibers about 5 to 10 microns in diameter with length to diameter ratios of about 5 to 10 were prepared for electroless plating by immersion in 500 ml of a room temperature sensitizing solution. The solution contained 55 g/l reagent grade stannous chloride ($SnCl_2.2H_2O$) dissolved in distilled water. The fibers were rinsed in cold water and then immersed for three minutes in 500 ml of an activating solution heated to a temperature of 54° C.

The activating solution contained 0.25 g/l palladium chloride ($PdCl_2$) and 4.5 ml/l reagent grade hydrochloric acid in distilled water. The fibers were rinsed again in cold water and delivered to an electroless nickel or copper plating bath.

The copper bath comprised an aqueous solution of 15 g/l copper sulfate ($CuS0_4.5H_2O$), 30 g/l reagent grade sodium tartrate ($Na_2C_4H_4O_6.2H_2O$), 14 g/l sodium hydroxide (NaOH) and 10 ml/l of a 36% by weight solution of formaldehyde in water. 5 grams of the fibers pretreated as above were immersed in the bath at room temperature for about 15 minutes. The fibers were dried and weighed. The total weight of copper coating on the fibers was found to be 0.7 grams.

The nickel bath comprised an aqueous solution of 17 g/l nickel sulfate ($NiSO_4$), 13 g/l sodium hypophosphite ($NaH_2PO_2.H_2O$), and 12 ml/l concentrated acetic acid. The solution was stabilized with 3 ml/l of a solution of 15.3 g of ammonium molybdate [$(NH_4)_6Mo_7O_{27}.4H_2O$] dissolved in a liter of water. The pH was adjusted to about 5.0 with sodium hydroxide. 5 grams of the activated fibers were immersed in the bath maintained at a temperature of about 180° F. for about 15 minutes. The fibers were dried and weighed. The total weight of the nickel coating on the fibers was found to be 1.4 grams.

The rotor electrode material was made by mixing 2.5 parts by weight of the copper or nickel plated fibers with 97.5 parts by weight −200+300 mesh copper powder and water in a high shear blender. The mixture was dewatered in a vacuum filter and vacuum hot pressed in a graphite die at 1450° F. at a pressure of 4000 psi for 15 minutes. Distributor electrode tip segments were sawed from the hot pressed composite materials. The tips tested in the bench testing equipment described herein reduced gap breakdown voltages to below 10 kV and RFI noise to below 10 relative db.

Electrode tip segments were also formed with the above described synthetic refractory dielectric fibers: Saffil®, Zircar®, and Fiberfrax®. Chopped fibers less than about 100 microns in diameter with a length to diameter ratio of about 5 to 10 were mixed with 97.5, 95, and 90% by weight copper powder and agitated with water in a high shear blender. The mixtures were filtered, dewatered, and compacted under 17.5 tons per square inch pressure. The resulting compacts were sintered in a hydrogen atmosphere for 30 minutes at 1500° F., repressed at a pressure of 25 tons per square inch and resintered for 30 minutes at 1500° F. in a hydrogen atmosphere. Distributor electrode tip segments were sawed from the material. Tips tested in the bench testing equipment described herein were found to reduce gap breakdown voltages to below 10 kV and reduce RFI noise to below 10 relative db.

While our invention has been disclosed in terms of specific embodiments thereof, it will be appreciated that other forms could readily be adapted by one skilled in the art. Accordingly, the scope of our invention is to be considered limited only by the following claims.

What is claimed is:

1. In an ignition distributor system for an internal combustion engine of the type wherein a high voltage is produced for an engine spark plug by a high voltage electrical discharge across a gap between a distributor electrode and a spark plug lead terminal, the improvement wherein, at least an end portion of said electrode adjacent said gap consists essentially of interspersed phases of discrete fibers of a dielectric material and an electrically conductive material, a portion of said dielectric fibers protruding from the end of said electrode into said gap, promoting breakdown across the gap and tending to suppress radio interference.

2. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip is composed of interspersed phases of a conductive material and fibers of a dielectric material, a portion of the dielectric fibers protruding from the conducting material to define a nonuniform electric field which encourages breakdown across the gap and tends to suppress radio interference.

3. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip contains interspersed phases of fibers of a dielectric material and a conductive material, said dielectric fibers being present in an amount of at least 10% by volume of the tip, the dielectric fibers having a length to diameter ratio of at least about 5:1, a portion of said fibers protruding from the conducting material to define a nonuniform electric field which encourages breakdown across the gap and tends to suppress radio interference.

4. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip contains a dielectric fiber phase interspersed with a copper phase, said dielectric fibers being present in an amount of at least 10% by volume of the tip, a portion of said dielectric fibers being anchored in and protruding from the copper to define a nonuniform electric field which encourages breakdown across the gap and tends to suppress radio interference.

* * * * *